US006889624B1

(12) United States Patent
Mulhern

(10) Patent No.: US 6,889,624 B1
(45) Date of Patent: May 10, 2005

(54) GRAPPLE ANCHOR DEVICE FOR UNDERWATER TOWING OF WATERCRAFT

(75) Inventor: Francis M. Mulhern, Riverton, NJ (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 25 days.

(21) Appl. No.: 10/826,902

(22) Filed: Apr. 19, 2004

(51) Int. Cl.[7] ..... B63B 21/04
(52) U.S. Cl. ..... 114/253; 114/221 R
(58) Field of Search ..... 114/253, 254, 221 R

(56) References Cited

U.S. PATENT DOCUMENTS 5,241,920 A * 9/1993 Richardson ..... 114/246
5,555,669 A * 9/1996 Fitzgerald ..... 43/44.96
5,620,298 A * 4/1997 Barwise ..... 414/734
5,689,086 A * 11/1997 Stottlemyer ..... 102/411

* cited by examiner

*Primary Examiner*—Stephen Avila
(74) *Attorney, Agent, or Firm*—Jacob Shuster

(57) ABSTRACT

A grapple anchor device suspended underwater from an unmanned watercraft has prongs pivotally mounted on its tubular housing for hooked engagement with a tow line extended from a retrieval ship so as to tow the watercraft underwater toward the ship. A tow rod within the grapple anchor housing, connected by an anchor line to the watercraft being towed, undergoes dampened axial displacement to condition the grapple anchor device for automatic release of the prongs from the tow line in response to a reduction in the towing force exerted through the tow line after the watercraft is towed into position adjacent the retrieval ship and undergoes crane lift up onto the retrieval ship by its shipboard crane so that the tow line may be withdrawn while the watercraft is transferred onto the ship.

11 Claims, 4 Drawing Sheets

GRAPPLE ANCHOR DEVICE FOR UNDERWATER TOWING OF WATERCRAFT

STATEMENT OF GOVERNMENT INTEREST

The invention described herein may be manufactured and used by or for the Government of the United States of America for governmental purposes without the payment of any royalties thereon or therefore.

The present invention relates to underwater towing of watercraft toward a retrieval ship for shipboard crane transfer thereto.

BACKGROUND OF THE INVENTION

Current methods for retrieving unmanned watercraft vehicles at sea involve manual handling of the watercraft after attachment thereof to an elongated tow line extended from a retrieval ship and subsequent manual detachment of the tow line from the towed vehicle for shipboard crane transfer of the watercraft onto the ship. Such retrieval methods are very cumbersome and manpower intensive. It is therefore an important object of the present invention to provide for such towing delivery of watercraft to a retrieval ship while avoiding the problematic manual processing involved.

SUMMARY OF THE INVENTION

In accordance with the present invention a grapple anchor device stowed on board an unmanned watercraft vehicle is deployed by suspension underwater therefrom through an anchor line attached by a loop ring to one axial end of the grapple anchor device. Prongs hingedly mounted at an opposite end of the suspended grapple anchor device are hooked to a tow line being swept below the watercraft by deployment from a retrieval ship, for underwater towing of the unmanned watercraft through the grapple anchor device which is thereby placed under tension and primed for automatic release of the prongs from the tow line in response to a reduction in the towing force in the tow line as it is winched into the retrieval ship when the watercraft is towed to a location adjacent thereto. During release of the grapple anchor device from the tow line, the watercraft is lifted onboard the retrieval ship by a crane. Release of the grapple anchor device prongs from the tow line is effected by slidable displacement of a locking collar on a tubular housing of the grapple anchor device to a release position by a pulley line actuator rendered operative by axial displacement of a towing rod during towing. The towing rod extends from one end of the tubular housing for attachment by the loop ring and the anchor line to the watercraft. Dampening means within the tubular housing minimizes such displacement of the towing rod to timely institute release of the tow line.

BRIEF DESCRIPTION OF THE DRAWING

A more complete appreciation of the invention and many of its attendant advantages will be readily appreciated as the same becomes better understood by reference to the following detailed description when considered in connection with the accompanying drawing wherein.

DETAILED DESCRIPTION OF THE PREFERRED EMBODIMENT

Figure 1:
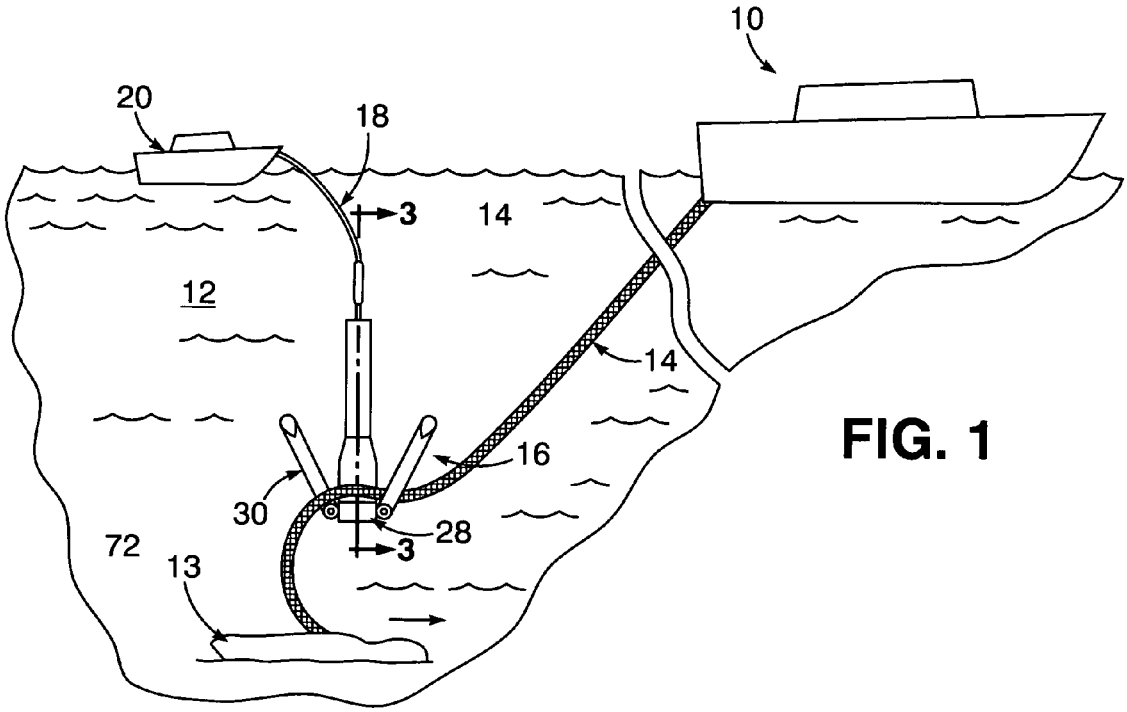
FIG. 1 is a side elevation view of a grapple anchor device suspended underwater below an unmanned watercraft and hooked by a tow line to a retrieval ship.
Figure 2:
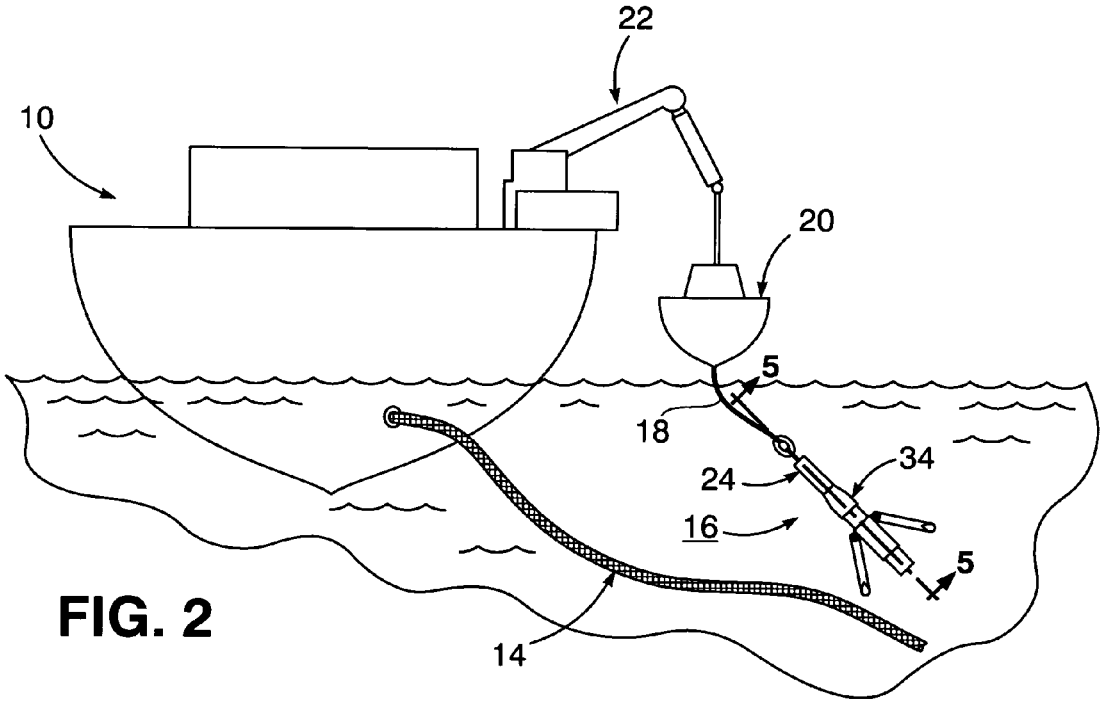
FIG. 2 is a side elevation view of the watercraft being lifted onboard the retrieval ship with the grapple anchor device suspended therefrom disengaged from the tow line.

Referring now to the drawing in detail, FIG. 1 illustrates a retrieval ship 10 in seawater 12, from which a tow line 14 extends, held deployed within the seawater 121 by a paravane 13 for hooked engagement of the tow line 14 by a grapple anchor device 16 suspended by a 30 foot long anchor line 18 from an unmanned watercraft or seawater vehicle 20. The grapple anchor device 16 was stowed onboard the unmanned vehicle 20 from which it was released for suspension within the seawater 12 below the vehicle 20 by the anchor line 18, within which tension is then applied in opposition to that in the tow line 14. Such tension applied to the grapple anchor 16 is dampened during towing to thereby place the grapple anchor device 16 in primed condition as hereinafter explained. When the unmanned vehicle 20 is towed by winch-in of the tow line 14 into the retrieval ship 10 to a position adjacent thereto, it is then lifted up by a shipboard crane 22 as shown in FIG. 2. The tow line 14 is then released from the primed grapple anchor device 16 to enable transfer of the unmanned vehicle 20 onto the retrieval ship 10 by the shipboard crane 22.

Figure 3:
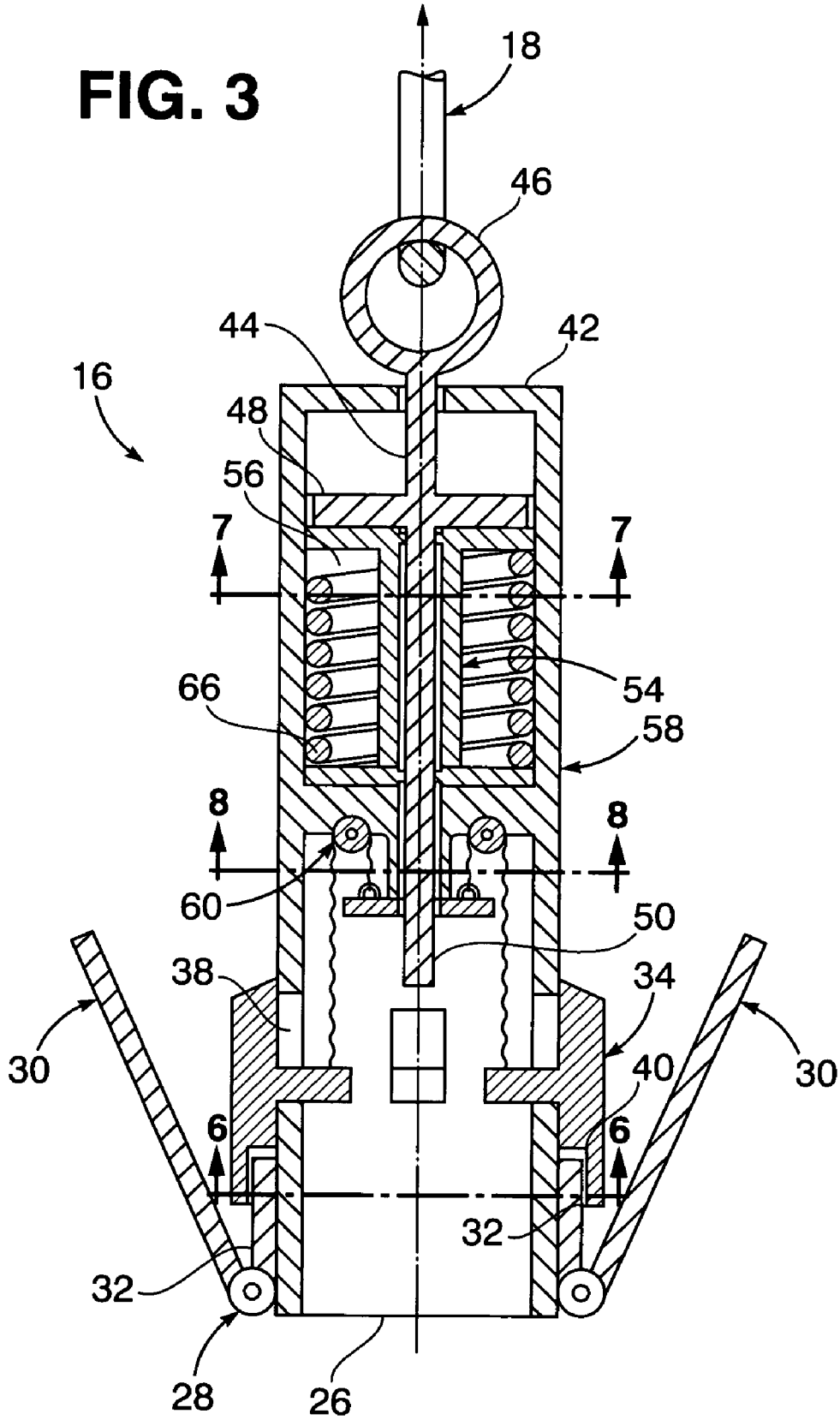
FIGS. 3 and 5 are section views taken substantially through planes indicated by section lines 3—3 in FIG. 1 and 5—5 in FIG. 2.
Figure 5:
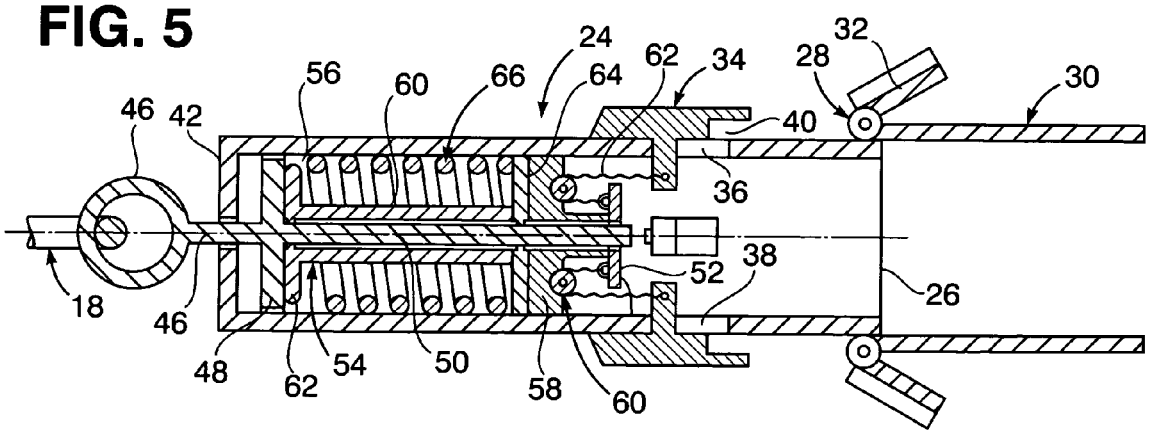
Figure 6:
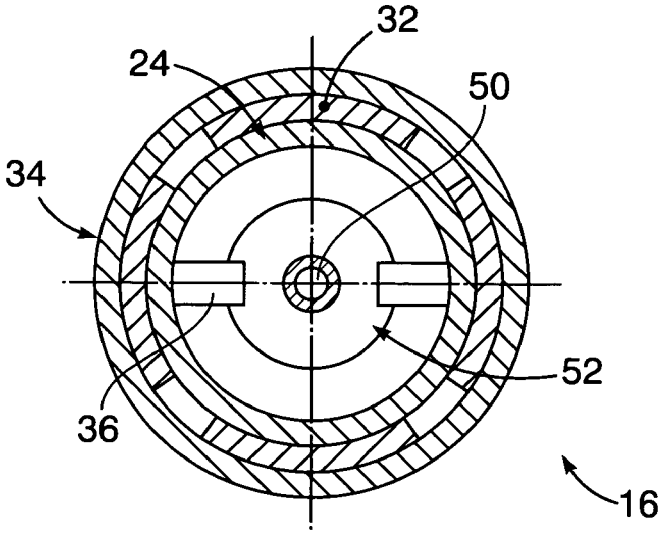
FIGS. 6, 7 and 8 are traverse section views taken substantially through planes respectively indicated by section lines 6—6, 7—7 and 8—8 in FIG. 3.
Figure 7:
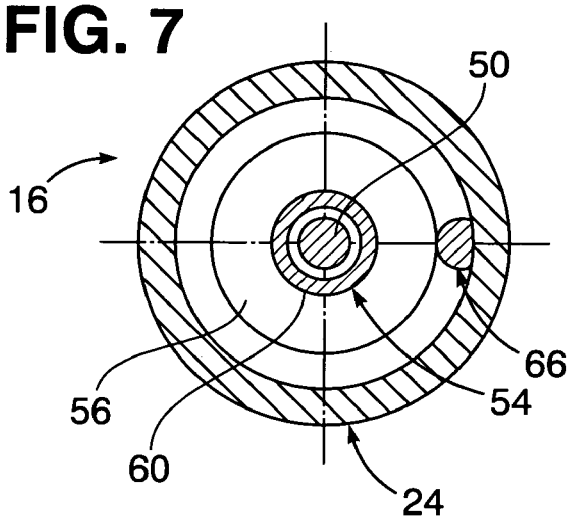
Figure 8:
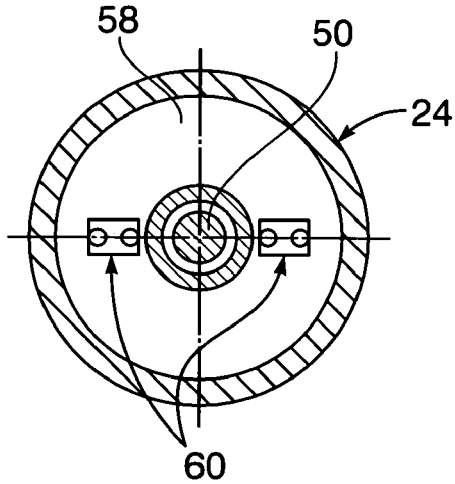

Referring now to FIGS. 1, 3 and 6, the grapple anchor device 16 has an elongated tubular housing 24 provided at one axial end 26 with a hinge assembly 28 through which four prongs 30 are pivotally connected to the housing 24 in 90° angular relation to each other. A tang 32 is connected to each of the prongs 30 in angular relation thereto. A cylindrical prong locking collar 34 is slidably mounted on the housing 24, with a pair of projections 36 extending radially inwardly therefrom through guide slots 38 formed in the housing 24. In the position of the collar 34 as shown in FIG. 3, the prong tangs 32 are held in prong locking contact with the housing 24 within an annular recess 40 formed in the collar 34. When the collar 34 is slidably displaced from its locking position shown in FIGS. 3 and 4 to a release position as shown in FIG. 5, the prong tangs 32 are disengaged for angular displacement with the prongs 30 to a release position extending in axial alignment with the housing 24 from its axial end 26, disengaged from the tow line 14.

Figure 4:
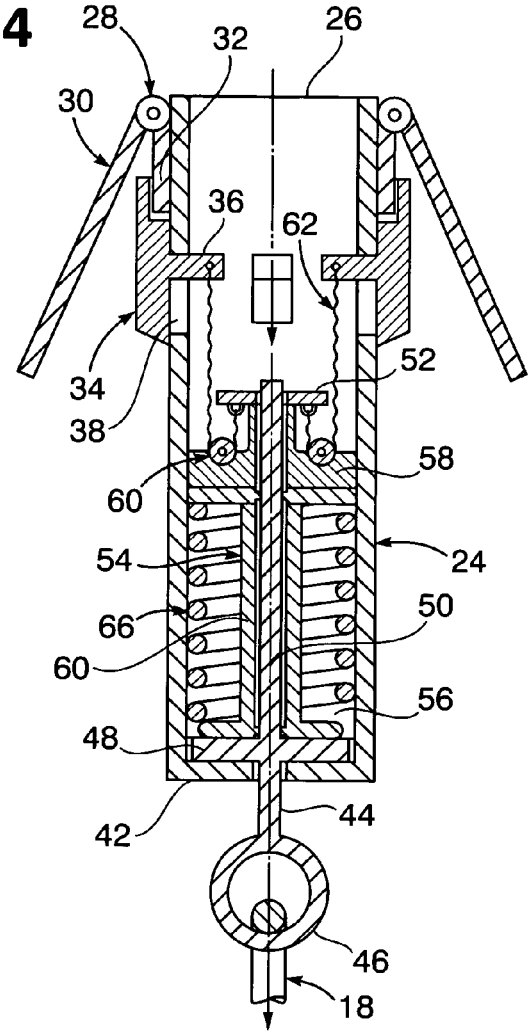
FIG. 4 is a section view of the grapple anchor device in a tow line engaging condition as shown in FIG. 1.

The other axial end of the housing 24 opposite the end 26 is closed by an end wall 42 having a central opening therein through which a connecting rod 44 extends and is connected to a loop ring 46 as shown in FIGS. 3, 4 and 5. The connecting rod 44 has a plunger disc 48 connected thereto within the housing 24, from which a central rod element 50 extends through a hole in a plunger plate 52. Axial displacement of the disc 48 and the rod element 50 from the position shown in FIG. 3 to the positions shown in FIGS. 4 and 5, imposed during suspension of the device 16 by the anchor line 18, is slowed down by a hydraulic dampener 54 positioned within a chamber 56 enclosed within the housing 24 between the end wall 42 and an intermediate support 58. The hydraulic dampener 54 includes a flexible deformable tube 60 sealed at opposite axial ends on the plunger rod element 50 by end discs 62 and 64 in respective engagement with the plunger disc 48 and the support 58. Enclosed within the tube 60 about the rod element 50 is a suitable dampening fluid. Also a coil spring 66 is positioned within the housing chamber 56 in axial engagement at opposite ends thereof with the dampener end discs 62 and 64 to further resist excessive inward plunger displacement of the plunger disc 48 and the rod element 50 from the initial position as shown in FIG. 3.

Displacement of the collar 34 from its prong locking position shown in FIGS. 3 and 4 to the release position shown in FIG. 5 is effected through pulleys 60 on the support 58 from which pulley lines 62 extend. The pulley lines 62 are anchored between the collar projections 36 and the plunger plate 52. Thus, when the plunger rod element 50 is axially displaced inwardly in one axial direction to the position shown in FIG. 5, it displaces the plunger plate 52 inwardly on the rod element 50 so as to pull on the pulley line 62 and exert an axial release force on the collar 34 through the collar projections 36. A one-way latch (not shown) may be utilized to transmit the pulley force between the plunger rod element 50 and the plunger plate 52 in one direction only.

It will be apparent from the foregoing description that the grapple anchor device 16 when ejected from its stow position on the unmanned vehicle 20 into the seawater 12, sinks and hangs suspended therebelow by the anchor line 18, with the prongs 30 locked in position by the collar 34 so as to accommodate its engagement by the tow line 14 held deployed from the retrieval ship 10 by the paravane 13 as shown in FIG. 1. The unmanned vehicle 20 may then be towed through the grapple anchor device 16 in its primed condition as shown in FIG. 4 by winch-in of the tow line 14 into the retrieval ship 10. During such towing action the tension in the tow line 14 increases depending on towing speed to exert a pulling force on the plunger rod element 50 against the bias of the spring 66 to impart axial displacement thereto, minimized by the dampener 54 so as to prime the grapple anchor device 16 for subsequent release of the prongs 30 held by the collar 34 in working position as shown in FIG. 4. The rod element 50 is then prevented from being pulled back through the hole in the plate 52. The tow line 14 is thereafter disengaged from the prongs 30 when the vehicle 20 positioned adjacent the retrieval ship 10 is lifted up by the shipboard crane 22 as shown in FIG. 2, with the collar 34 of the grapple anchor device 16 slidably displaced to its release position as shown in FIG. 5, as a result of a reduction in tension exerted through the tow line 14. Upon such release of the tow line 14 from the prongs 30 the tow line 14 falls off the grapple anchor device 16 and is pulled up by continued winch-in to the deck of the ship 10. Such tow line disengagement from the grapple anchor device 16 involves axial displacement of the plunger disc 48 fixed to the plunger rod element 50 from the housing end well 42, with force transfer to the plunger plate 52 so as to position it by means of the actuator pulleys 60 as shown in FIG. 5. The plunger plate 52 thereby pulls on the pulley lines 62 connected to the collar 34 through its projections 36 so as to slidably displace the collar 34 to the release position shown in FIG. 5, releasing the prong tangs 32 to enable the prongs 30 to be pivotally displaced to the positions shown in FIGS. 2 and 5, allowing the tow line 14 to slide off the prongs 30 for release of the grapple anchor device 16 therefrom. The unmanned vehicle 20 may then be transferred to the retrieval ship 10 by the crane 22.

According to other towing operations the small unmanned vehicle boat 20 and the grapple anchor device 16 suspended therefrom by the anchor line 18 sit motionless in the seawater 12, while the retrieval ship 10 sweeps by to snag the grapple anchor device 16 onto the tow line 14 to begin pulling the paravane 13. When the tow line 14 is thereafter reeled into the retrieval ship 10, the tow line 14 slides through the anchor prongs 30 until the paravane 13 engages the grapple anchor device 16. Continued reel in of the tow line 14 then causes both the anchor device 16 and the paravane 13 to approach the ship 10 dragging the unmanned vehicle 20 closer to the ship 10 for retrieval.

In view of the features of the grapple anchor device 16 as hereinbefore described, the unmanned vehicle 20 may be towed without manual control or maneuver and without stopping of the ship 10 for retrieval purposes. Also withdrawal of the tow line 14 from the self-releasing grapple anchor device 16 is effected at the desired time without manual intervention.

Obviously, other modifications and variations of the present invention may be possible in light of the foregoing teachings. It is therefore to be understood that within the scope of the appended claims the invention may be practiced otherwise than as specifically described.

What is claimed is:

1. In combination with a towing line extended from a retrieval ship, a grapple anchor device hooked to the towing line for underwater towing of an unmanned vehicle toward the retrieval ship, comprising: an elongated housing; prong means pivotally connected to the housing for engagement by the tow line under a towing tension during said towing of the unmanned vehicle; rod means coupled to the unmanned vehicle by an anchor line and extending into the housing for displacement therein in response to said towing tension exerted by the tow line; lock means mounted on the housing for holding the prong means in a towing position on the housing hooked to the tow line during said towing of the unmanned vehicle; and actuating means operatively connected to the lock means within the housing for release of the prong means from the tow line in response to a reduction in said towing tension in the tow line upon termination of said towing of the unmanned vehicle.

2. The grapple anchor device as defined in claim 1, including: dampening means within the housing for minimizing said displacement of the rod means during said towing of the unmanned vehicle; and spring means within the housing for directionally biasing the rod means in opposition to the displacement imparted thereto by the tow line through the prong means during said towing of the unmanned vehicle.

3. The grapple anchor device as defined in claim 2, wherein the rod means comprises: an elongated rod element within the housing; a plunger disc connected to the rod element within the housing in engagement with the dampening means; a loop ring interconnecting the plunger disc with the anchor line externally of the housing; and plunger plate means operatively connecting the rod element within the housing to the actuating means in axially spaced relation to the plunger disc for release of the lock means from the towing position holding the prong means hooked to the tow line.

4. The grapple anchor device as defined in claim 3, wherein the lock means comprises: a collar slidably mounted on the housing, having a projection extending through a slot in the housing and connected to the actuating means therein.

5. The grapple anchor device as defined in claim 4, wherein said actuating means includes: a pulley rotatably mounted within the housing; and a flexible pulley line positioned on the pulley and interconnected at opposite ends thereof to the plunger plate means on the rod element and the collar projection.

6. The grapple device as defined in claim 1, wherein the lock means comprises: a collar slidably mounted on the housing, having a projection extending through a slot in the housing and connected to the actuating means therein.

7. The grapple device as defined in claim 6, wherein said actuating means includes: a pulley rotatably mounted within the housing; and a flexible pulley line positioned on the pulley and interconnected at opposite ends thereof to the plunger plate means on the rod element and the collar projection.

8. In combination with an underwater tow line, a grapple anchor device through which a watercraft undergoes towing, comprising: a tubular housing; an elongated rod connected to the watercraft and extending into the housing; prong means pivotally mounted on the housing for controlled hooking engagement with the tow line; lock means on the housing for displacement thereon between locking and release positions respectively holding and releasing the prong means from said hooking engagement with the tow line; and actuating means engaged by the rod in response to displacement thereof in one direction within the housing during said towing of the watercraft for imparting said displacement to the lock means to the release position in response to a reduction in towing force applied through the towing line and the prong means to the grapple anchor device.

9. The combination as defined in claim 8, including: dampening means within the housing for minimizing said displacement of the rod during said towing of the watercraft.

10. The combination as defined in claim 9, wherein said lock means comprises: a collar slidably mounted on the housing having an annular recess within which the prong means is engaged.

11. The combination as defined in claim 8, wherein said lock means comprises: a collar slidably mounted on the housing having an annular recess within which the prong means is engaged.

* * * * *